US005086627A

United States Patent [19]

Borgen

[11] Patent Number: 5,086,627

[45] Date of Patent: Feb. 11, 1992

[54] REMOVABLE COOLING UNIT FOR DISPLAY CASE AND METHOD FOR USING SAME

[75] Inventor: Arden L. Borgen, Des Moines, Iowa

[73] Assignee: Margaret Platt Borgen, Des Moines, Iowa

[21] Appl. No.: 615,038

[22] Filed: Nov. 19, 1990

[51] Int. Cl.[5] ..... F25D 19/00

[52] U.S. Cl. ..... 62/229; 62/256; 62/298

[58] Field of Search ..... 62/77, 256, 298, 229; 165/903, 918, 919, 122

[56] References Cited

U.S. PATENT DOCUMENTS

| | | | |
|---|---|---|---|
| 1,841,616 | 1/1932 | Lipman | 62/298 |
| 2,546,417 | 3/1951 | Anglin | 62/298 X |
| 2,911,798 | 11/1959 | Gould | 62/229 X |
| 3,433,031 | 3/1969 | Scheitlin et al. | 62/298 X |
| 3,712,078 | 1/1973 | Maynard et al. | 62/448 |
| 4,019,339 | 4/1977 | Anderson | 62/255 |
| 4,312,190 | 1/1982 | Abraham et al. | 62/255 |
| 4,457,140 | 7/1984 | Rastelli | 62/298 X |
| 4,898,004 | 2/1990 | Richardson | 62/298 X |
| 4,949,554 | 8/1990 | Branz et al. | 62/298 X |
| 4,995,243 | 2/1991 | Ward | 62/298 |

FOREIGN PATENT DOCUMENTS

| | | | |
|---|---|---|---|
| 3240124 | 5/1984 | Fed. Rep. of Germany | 62/298 |

*Primary Examiner*—William E. Tapolcai
*Attorney, Agent, or Firm*—Zarley, McKee, Thomte, Voorhees & Sease

[57] ABSTRACT

A display case includes a display case housing having an open upper end. Fitted over the open upper end is a removable cooling unit which has an inlet opening and an outlet opening both in communication with the interior of the display case. The cooling unit draws air into the cooling unit, cools the air, and recirculates it into the display case. The cooling unit can be removed from the upper end of the housing for repair, and can be replaced with a similar unit so that the display case can continue to be used. A modified form of the invention includes a cooling unit which is insertable into the display compartment of the display case adjacent the bottom wall thereof.

4 Claims, 3 Drawing Sheets

REMOVABLE COOLING UNIT FOR DISPLAY CASE AND METHOD FOR USING SAME

BACKGROUND OF THE INVENTION

This invention relates to a removable cooling unit for display case and a method for using the same.

Cooled display cases are used for many purposes. They can be used to store and display flowers in a florist shop, food in a grocery store, or other products that require cooling.

Conventionally these cooled display units have incorporated therein a cooling unit utilizing a compressor, cooling coils, etc. However, in conventional cooled display cases, the cooling unit is an integral part of the display case. Thus, when the cooling unit breaks down, the entire display case is rendered inoperable.

Therefore, a primary object of the present invention is the provision of an improved removable cooling unit for a display case and a method for using same.

A further object of the present invention is the provision of a cooling unit which can be easily removed and replaced in the event that it becomes defective or requires repair.

A further object of the present invention is the provision of a removable cooling unit which can be replaced by an identical unit so as to permit the cooled display case to continue to be used while the first cooling unit is being repaired.

A further object of the present invention is the provision of a removable cooling unit and method for using same, wherein the cooling unit fits and connects with an air dispersal duct system located within the display case.

A further object of the present invention is the provision of an improved removable cooling unit which can be placed on top of the display case.

A further object of the present invention is the provision of an improved removable cooling unit which can be inserted within the display case and removed from the display case when repairs are needed.

A further object of the present invention is the provision of a removable cooling unit for display case and method for using same which is economical to manufacture, durable in use, and efficient in operation.

SUMMARY OF THE INVENTION

The present invention utilizes a cooling unit which can be fitted over the top of a display case having a display compartment therein. The cooling unit includes a cooling chamber therein having a cooling coil in the cooling chamber. An inlet opening is provided in the cooling unit for permitting air to enter the cooling chamber, and an outlet opening is provided to permit air to exit from the cooling chamber. A fan is within the cooling unit for causing air to be drawn into the inlet opening, passed over the cooling coil, and forced outwardly through the outlet opening of the cooling unit.

The cooling unit fits on top of the display case with its inlet opening and outlet opening both in communication with the interior display compartment within the display case. Thus, when the cooling unit is actuated, it draws air from the display case into the cooling chamber of the cooling unit, cools the air, and recirculates the air into the display case.

The display case includes a duct system which is registered with the inlet opening of the cooling unit. The duct system includes a lower open end adjacent the bottom of the display case and an upper end in registered alignment with the inlet opening of the cooling unit. This permits air to be drawn from the bottom of the display case up through the duct system into the cooling unit where it is cooled and then forced outwardly through the outlet opening of the cooling unit.

A modified form of the invention includes a cooling unit which can be placed on the floor of the display case within the display compartment. This unit also is adapted to be connected to the duct system of the display case so that cool air is forced into the duct system and carried upwardly to the upper end of the display case where it exits the duct system and is distributed adjacent the upper end of the display compartment. The inlet opening of the cooling unit is adjacent the bottom of the display case, and draws air inwardly at that location.

DESCRIPTION OF THE PREFERRED EMBODIMENT

Figure 1:
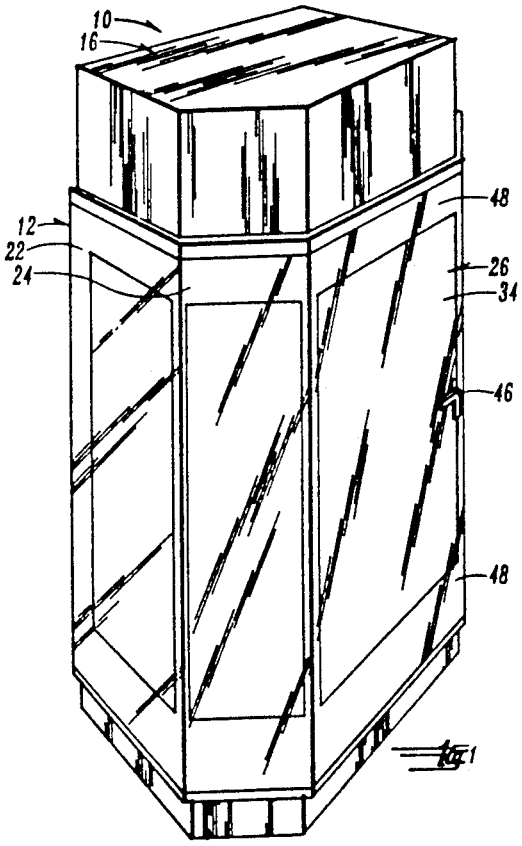
FIG. 1 is a perspective view of a display case having the cooling unit of the present invention thereon.
Figure 2:
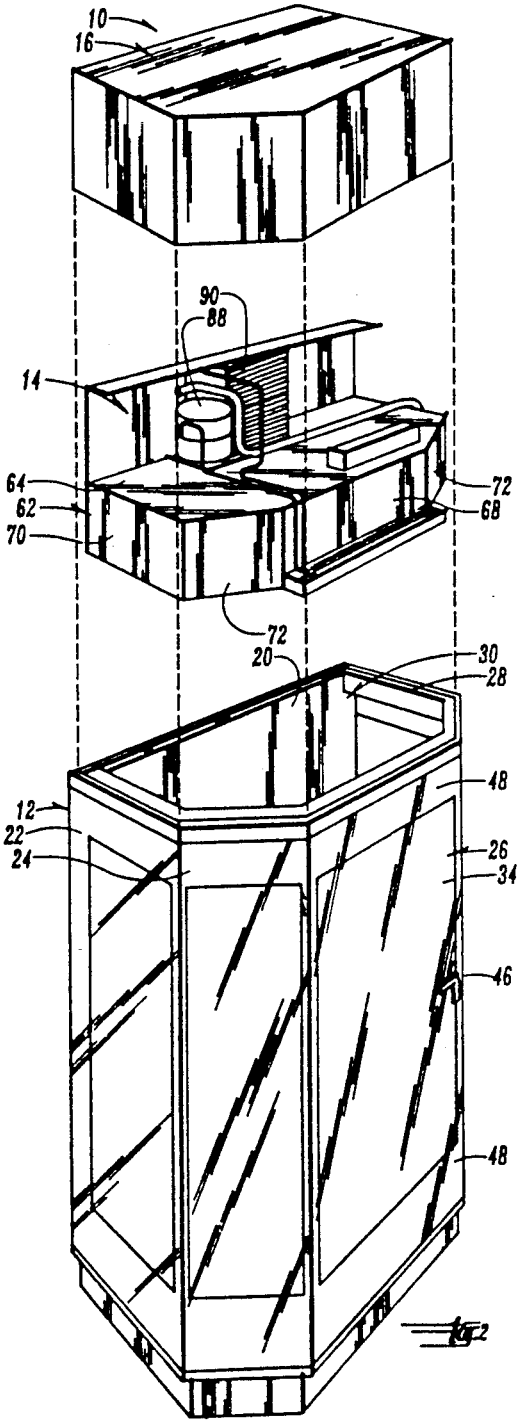
FIG. 2 is an exploded perspective view showing the display case, the cooling unit, and the canopy over the cooling unit.

Referring to the drawings, the numeral 10 generally designates the cooled display case of the present invention. Case 10 includes a case housing 12, a removable cooling unit 14, and a canopy 16 which is placed over the cooling unit. The case housing 12 comprises a bottom wall 18 (FIG. 3), a rear wall 20, sidewalls 22, 24 (FIGS. 1 and 2) and front wall 26. Extending around the upper edges of walls 22, 24, and 26 is a top frame 28 which defines a top opening 30 of a display compartment 31.

In front wall 26 is a door opening 32 over which is fitted a door 34. Door 34 includes three panes, an exterior pane 36, a middle pane 38, and an interior pane 40. Door 34 is hinged over the door opening 32 by means of an upper hinge 42 and a lower hinge 44. A handle 46 is provided on door 34 for permitting the opening and closing of the door. Walls 22 and 24 are of the similar three pane construction which is shown for door 34, although the walls 22, 24 are fixed. Each of the walls 22, 24, and the door 34 are provided with a painted black border 48 which defines an open window through which the contents of display compartment 31 may be seen. A plurality of shelves 50 are provided within the display compartment 31.

Extending upwardly along the back wall of display compartment 31 is a vertical duct 52 having an upper end 54 adjacent the top opening 30, and having a lower end 56 adjacent the bottom wall 18 of case housing 12. An upper light 58 is provided adjacent the upper edge of door opening 32 and a lower light 60 is provided adjacent the lower edge of door opening 32.

Figure 3:
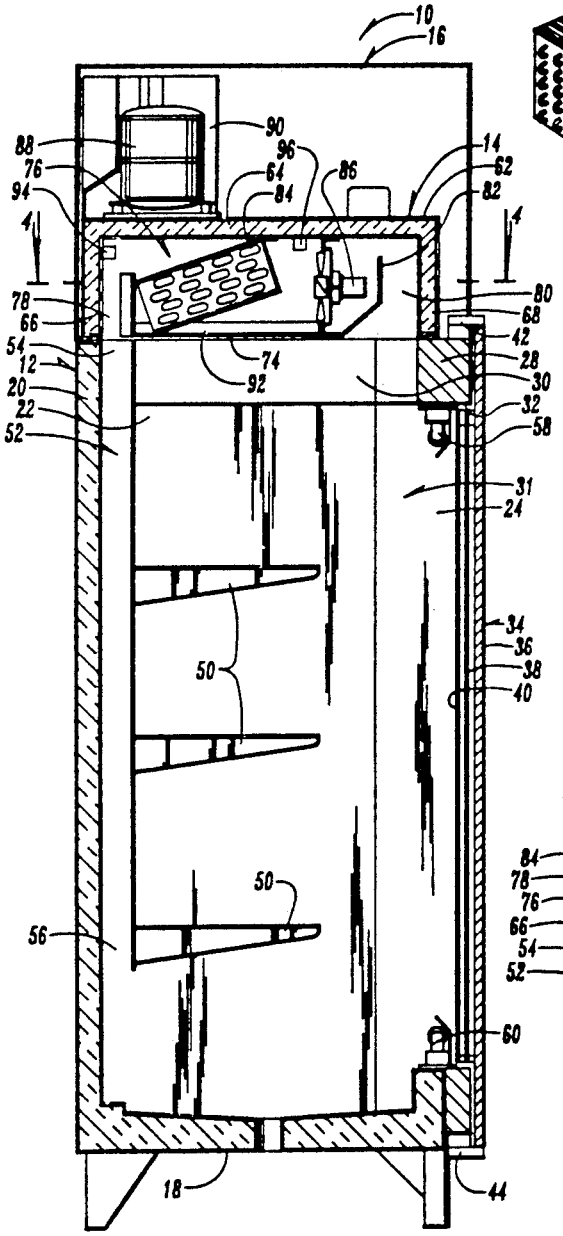
FIG. 3 is a side sectional view of the display case having the cooling unit thereon.

Cooling unit 14 comprises a cooling unit housing 62 which includes a top wall 64, a rear wall 66, a front wall 68, and sidewalls 70, 72. Housing 62 is formed in a shape which conforms to the cross-sectional configuration of case housing 12, and which fits in registered alignment over top opening 30 of case housing 12. Cooling housing 62 includes a bottom wall 74, and housing 62 contains therein a cooling chamber 76. An inlet duct 78 provides communication into cooling chamber 76, and an outlet duct 80 provides communication out of chamber 76. As can be seen in FIG. 3, the inlet duct 78 is in registered alignment with the upper end 54 of vertical duct 52, and the outlet duct 80 of cooling unit 14 is in communication with the interior of display compartment 31 adjacent the upper front edge thereof.

Housing 62 includes a vertical baffle 82 adjacent the front end thereof which in part forms the outlet duct 80. Within cooling chamber 76 are a cooling coil 84 and a fan 86. Located outside the cooling chamber on top of top wall 64 of the cooling unit 12 are a compressor 88 and a condenser 90. A drip pan 92 is provided adjacent bottom wall 74 of the cooling unit for accumulating condensation from the cooling coil 84. A first thermostat 96 is located within cooling chamber 76 in a position where it can sense the temperature of the air passing over cooling coil 84. A second thermostat 94 is located either within vertical duct 52 adjacent the upper end thereof, or it can be placed within inlet duct 78 of the cooling unit 14 so as to sense the temperature of air entering the cooling unit.

Figure 5:
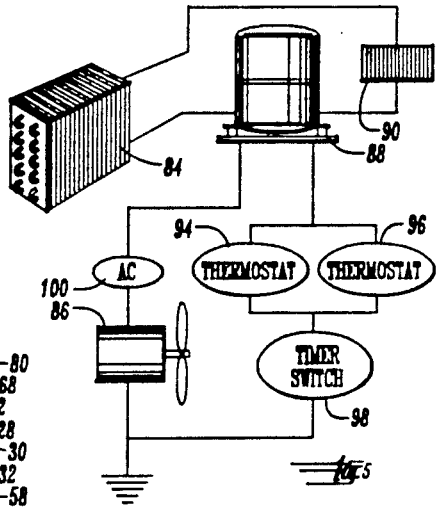
FIG. 5 is a schematic diagram showing the cooling circuitry and showing the electric circuitry for operating the cooling system.
Figure 4:
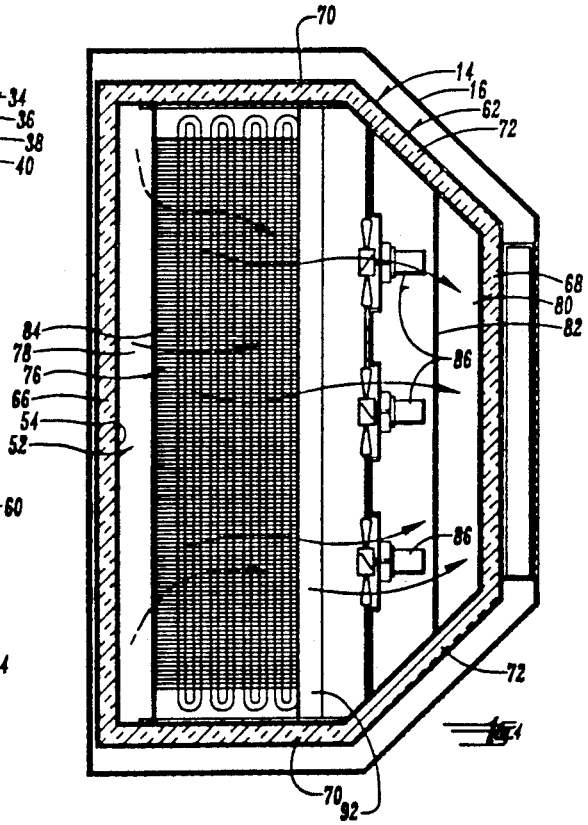
FIG. 4 is a sectional view taken along line 4—4 of FIG. 3.

Referring to FIG. 5, the circuitry for the cooling unit is shown. Compressor 88 is connected by conduits to the cooling coil 84 which in turn is connected to condenser 90 located outside the cooling chamber 76. Operation of the compressor 88 causes the cooling coil 84 to be cooled in conventional fashion. The compressor is operated by electrical circuitry which includes an alternating current source 100, the fan 86, and the two thermostats 94, 96, as well as timer switch 98. Each of the thermostats 94, 96 is set at a predetermined setting which causes actuation of the compressor 88. The thermostat 96 is set at a higher level than the thermostat 94. Thus, if the air returning from the display case exceeds a predetermined level which is sensed by thermostat 96, the compressor will be actuated. Similarly, if the air coming off of the cooling coil 84 exceeds a predetermined temperature, the thermostat 94 will actuate the compressor 88. The timer switch 98 times the periodic intervals at which the compressor 88 operates.

The cooling unit 14 is completely self-contained, and rests upon the upper end of display case housing 12. Frame member 28 is welded into the upper end of case housing 12 so as to provide strong support for the weight which it bears from the cooling unit 14.

In the event that the cooling unit 14 becomes inoperable or needs repair, it can easily be lifted off of the top of the case housing 12 and replaced with a similar identical unit. Thus, it is not necessary for the display case 10 to be rendered inoperative during the time that cooling unit 14 is removed for repair. A similar cooling unit can easily be placed upon the top of the display case 10, and the display case can continue to operate.

Figure 6:
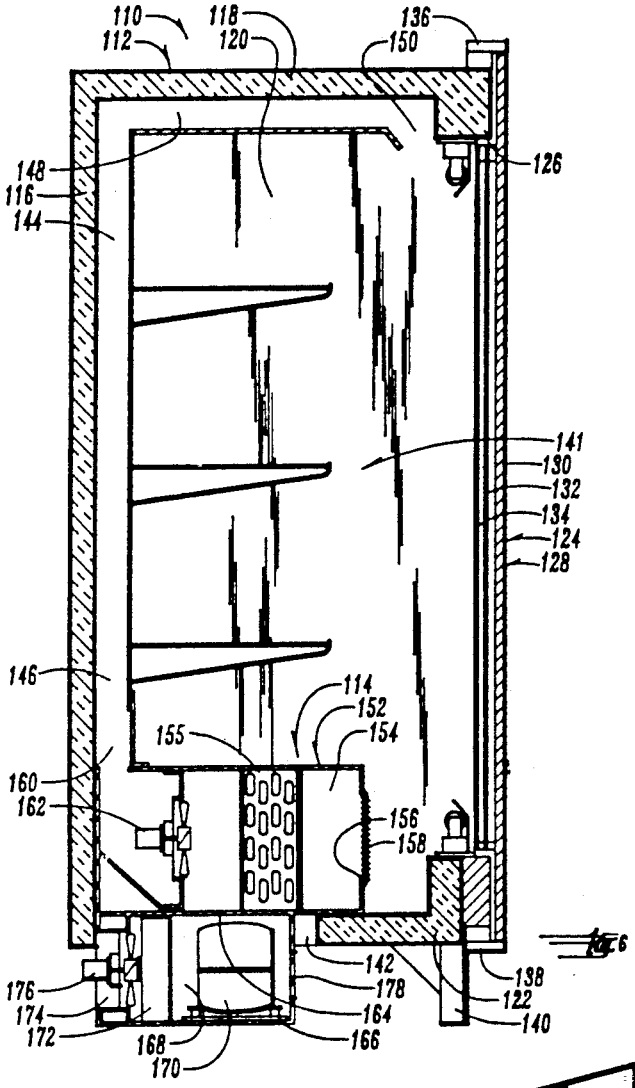
FIG. 6 is a sectional view showing a modified form of the present invention.
Figure 7:
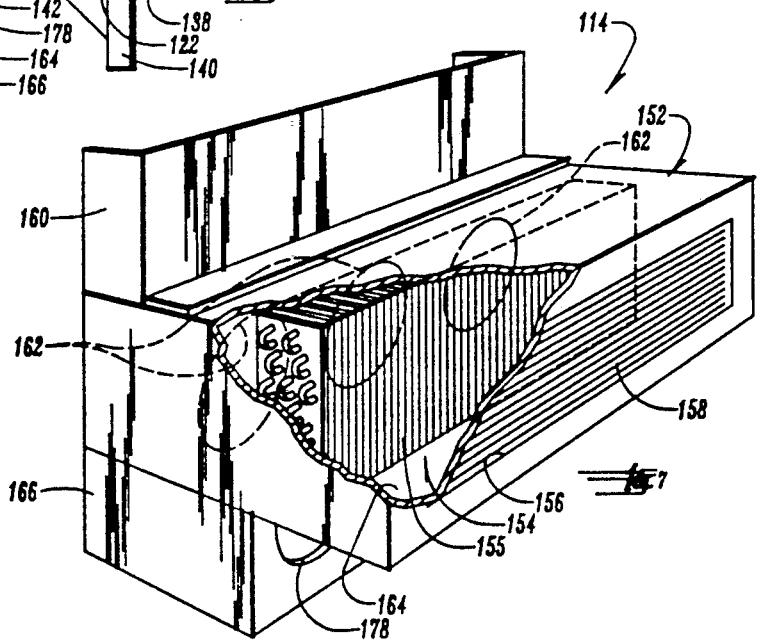
FIG. 7 is a perspective view of the cooling unit shown in FIG. 6.

Referring to FIGS. 6 and 7, a modified form of the invention is shown and is designated by the numeral 110. Display case 110 includes a case housing 112, and a removable cooling unit 114 which is adapted to be placed directly within the cooling device 110. Case housing 112 includes a rear wall 116, a top wall 118, sidewalls 120, bottom wall 122, and a front wall 124. A door opening 126 is provided in front wall 124, and a door 128 is hinged thereto. Door 128, similar to the door shown in the device of FIGS. 1-5, includes an outer pane 130, a middle pane 132, and an inner pane 134. The door 128 is hinged to the frame by means of an upper hinge 136 and a lower hinge 138. Several legs 140 support the case housing 112 in spaced relationship above a supporting surface.

Bottom wall 122 includes an opening 142 which is adapted to receive part of the cooling unit as will be described hereinafter.

Within the housing 112 is a display chamber 141. Along the back wall 116 is a vertical duct 144 having a lower end 146 spaced a short distance above the bottom wall 122. Duct 144 extends upwardly and includes a horizontal portion 148 which has a discharge opening 150 adjacent the upper front edge of the display chamber 141.

Cooling unit 114 includes a cooling unit housing 152 which defines therein a cooling chamber 154 having a cooling coil 155 therein. Cooling chamber 154 includes an inlet opening 156 which is covered by a screen or filter 158. An outlet duct 160 provides communication from the chamber 154 into the lower end 146 of vertical duct 144. As can be seen in FIGS. 6 and 7, the outlet duct 160 is shaped to fit in mating relationship with the lower end of 146 of vertical duct 144. A fan 162 is adapted to draw air into cooling chamber 154 through inlet opening 156.

A separating panel 164 separates the upper portion of housing 152 from a lower housing 166 which forms a compressor chamber 168 containing a compressor 170 therein. Also, a condenser 172 is in compressor chamber 168. A fan opening 174 is provided in the rear wall of compressor chamber 168 and is adapted to force air from outside the display device 10 into the compressor chamber 68 for cooling the condenser 172 and the compressor 170. An exhaust opening 178 is provided adjacent the front of the compressor chamber for permitting air to exit therefrom.

As can be seen in FIGS. 6 and 7, the lower housing 166 is adapted to fit within the opening 142 in bottom wall 122 of the display case housing 112. The cooling unit housing then protrudes forwardly so as to prevent air from exiting from the display chamber 120. The cooling unit 114 can be easily inserted or removed from the display case merely by opening the door 128 and inserting the cooling unit into the bottom of the display case 110. The compressor chamber 166 fits within the opening 142, and the outlet duct 160 of the cooling unit fits in registered alignment with the lower end 146 of vertical duct 144. As with the device shown in FIGS. 1-5, the cooling unit 114 can be removed if it becomes defective or if it needs repair, and a similar cooling unit can be inserted so that the display case 110 remains operative during the time the cooling unit is being repaired. Thus, it can be seen that the device accomplishes at least all of its stated objectives.

I claim:

1. A cooled display case comprising:

a case housing comprising a back wall, a bottom wall, sidewalls, and a front wall forming a display compartment, each of said back wall, front wall, and sidewalls having upper edges;

a top frame attached to said upper edges of said back wall, said front wall, and said sidewalls of said case housing, said top frame forming a top opening above said compartment of said case housing;

a door opening in said front wall;

a door hinged to said housing and covering said door opening;

a cooling unit housing having a top wall, a rear wall, a front wall, sidewalls, and a bottom wall forming a cooling chamber therein, said sidewalls of said cooling unit housing being formed in a shape which conforms to the shape of said top frame and resting in registered alignment above said top frame;

cooling means within said cooling chamber of said cooling unit for cooling air passing therethrough;

said bottom wall of said cooling unit housing having an air inlet duct and an air outlet duct providing communication through said top opening between said display compartment and said cooling chamber;

said cooling unit housing having a vertical baffle within said cooling chamber between said cooling means and said outlet duct and adjacent and forming a part of said outlet duct;

fan means within said cooling unit for drawing air into said inlet duct from said display compartment and for forcing said air through said cooling chamber, around said cooling means, around said vertical baffle, and through said outlet duct into said display compartment, whereby said cooling means cools said air as it passes through said cooling chamber;

a vertical duct having an open lower end within said display compartment adjacent said bottom wall of said case housing and having an upper open end registered with and closely adjacent said inlet duct of said cooling unit housing, whereby actuation of said fan causes air to be drawn into said lower end of said vertical duct and upwardly through said vertical duct into said inlet duct of said cooling unit;

a first thermostat positioned within said cooling chamber for sensing the temperature of the air within said cooling chamber;

a compressor mounted to said cooling unit housing and connected to said cooling means for causing said cooling means to be cooled;

said first thermostat being connected to said compressor for causing actuation of said compressor whenever the air temperature sensed by said thermostat is above a first predetermined level.

2. A display case according to claim 1 wherein said first thermostat is positioned downstream from said cooling means for sensing the temperature of air after it has passed over said cooling means.

3. A display case according to claim 1 wherein said first thermostat is positioned adjacent said intake duct for sensing the temperature of air passing therethrough.

4. A display case according to claim 2 wherein a second thermostat is positioned adjacent said intake duct for sensing the temperature of air passing therethrough, said second thermostat being connected to said compressor for causing actuation of said compressor whenever the air temperature sensed by said second thermostat exceed a second predetermined temperature above said first predetermined temperature.

* * * * *